US005226858A

United States Patent [19]

Snowdon

[11] Patent Number: 5,226,858

[45] Date of Patent: Jul. 13, 1993

[54] METHOD AND APPARATUS FOR PRODUCING BAGS INTERCONNECTED AT THEIR OPEN ENDS

[75] Inventor: Michael Snowdon, Demossville, Ky.

[73] Assignee: Equitable Bag Co., Inc., Long Island City, N.Y.

[21] Appl. No.: 843,414

[22] Filed: Feb. 27, 1992

[51] Int. Cl.[5] ..... B31B 23/20; B31B 23/86

[52] U.S. Cl. ..... 493/195; 493/198; 493/204; 493/238

[58] Field of Search ..... 493/194, 195, 196, 197, 493/198, 204, 233, 238

[56] References Cited

U.S. PATENT DOCUMENTS 2,775,082 12/1956 Vogt ..... 493/195
3,548,723 12/1970 Sengewald ..... 493/194
4,181,069 1/1980 Porter ..... 493/196
4,693,701 9/1987 DeBin ..... 493/198
4,699,607 10/1987 Lambrecht ..... 493/196
4,759,639 7/1988 DeMatteis ..... 383/7
4,790,803 12/1988 Roen et al. ..... 493/195
4,877,473 10/1989 Snowdon et al. ..... 156/204

*Primary Examiner*—William E. Terrell
*Attorney, Agent, or Firm*—Brumbaugh, Graves, Donohue & Raymond

[57] ABSTRACT

A method and apparatus for producing bags interconnected at their open ends by forming transverse seals across a flattened longitudinal tube of film material and utilizing a cutting die to cut a transverse weakened line across the tube intermediate the transverse seals and to cut a pair of handle openings, one on each side of the transverse weakened line.

8 Claims, 4 Drawing Sheets

METHOD AND APPARATUS FOR PRODUCING BAGS INTERCONNECTED AT THEIR OPEN ENDS

BACKGROUND OF THE INVENTION

This invention relates to a method and apparatus for producing merchandise bags interconnected at their open ends.

In one known method of making shopping bags, thermoplastic material is extruded to form a longitudinal tube of film which is flattened and made into individual bags, with or without side gussets, by forming spaced apart transverse seals across the tube. Each bag is then subjected to punching and cutting operations to impart the desired shape to the bag, to form handle openings and to cut the tube into individual bags.

Shopping bags are sometimes supplied in packs in which the bags are detachably connected, and the packs are suspended on supporting racks from which the bags are removed one bag at a time. Such bag pack supporting systems are disclosed in my U.S. Pat. No. 4,877,473 and my pending application, Ser. No. 768,996, filed Sep. 30, 1991. In some conventional bag pack supporting systems, the bags in the pack are provided with detachable tabs having aligned holes, and the supporting rack is provided with supporting arms or hooks for receiving the holes in the bags to support the pack, the bags being dispensed by detaching the bags from the tabs, for example, as shown in U.S. Pat. No. 4,759,639.

SUMMARY OF THE INVENTION

The present invention relates to a novel method and apparatus for making bags in which a pair of spaced apart transverse seals are formed across an extruded, flattened longitudinal tube of film, with or without side gussets, the spacing between the transverse seals being two bag lengths, thereby providing a pair of bags interconnected across their open ends. that is to say, interconnected "open-end to open-end". The bags can be shaped and formed at this stage by die cutting the bags intermediate the transverse seals or, preferably, by cutting the flattened longitudinal tube along the transverse seals, stacking a plurality of the cut lengths of tube and then die cutting the entire stack in one operation to produce a stack of interconnected bags. The cutting die can also be equipped with hot pins or cold weld pressure pins to spot weld the bags together so that the stack can be handled as a pack of detachably connected bags.

The cutting die produces in a single operation either a pair of bags connected open-end to open-end along a weakened line or a stack of such interconnected bags, for example, 50 or 100 such pairs of interconnecting bags.

In a preferred method and apparatus, the cutting die produces in a single cutting operation:

1) a weakened connection separating the pairs of bags in the stack;

2) handle openings in the upper ends of the bags on each side of the weakened connection;

3) detachable tabs for each bag connected to the respective bag by weakened connections; and 4) openings or slits in the tabs to permit the bags to be suspended by supporting arms or hooks.

As mentioned above, the cutting die can also be equipped with pins for spot welding the bags so that they can be handled as a pack.

The interconnected pairs of bags in the stack can be folded in the center to form two interconnected packs of bags with frangible tabs broken by the user as bags are detached or they can be separated into two individual packs by separating the bags along their transverse weakened interconnections. In many cases, the bag dispensing method will permit the bags to be folded which improves the single bag dispensing feature of bag dispensing systems, since the second bag is folded under the first bag, providing resistance so that it will not pull out until the initial stack is worked down to it.

The invention affords significant increase in bag production. Bag production cycles are restricted by mechanical limitations, and the invention makes it possible to produce two bags per bag machine cycle.

DESCRIPTION OF PREFERRED EMBODIMENTS

Figure 1:
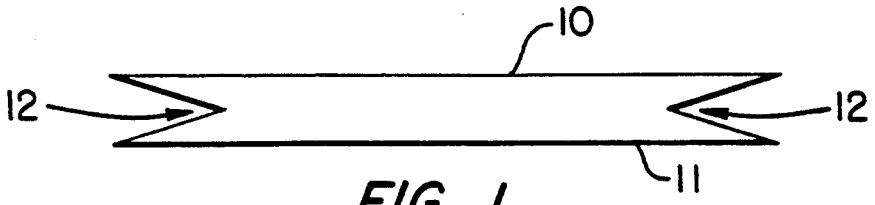
FIG. 1 is an end view of a longitudinal tube of extruded thermoplastic film formed with side gussets.

As is conventional, the merchandise bags of the present invention are formed from a flatted tube, shown in FIG. 1 as comprising a pair of wall panels 10, 11 and a pair of side gussets 12, extruded from thermoplastic film, such as high density polyethylene.

Figure 2:
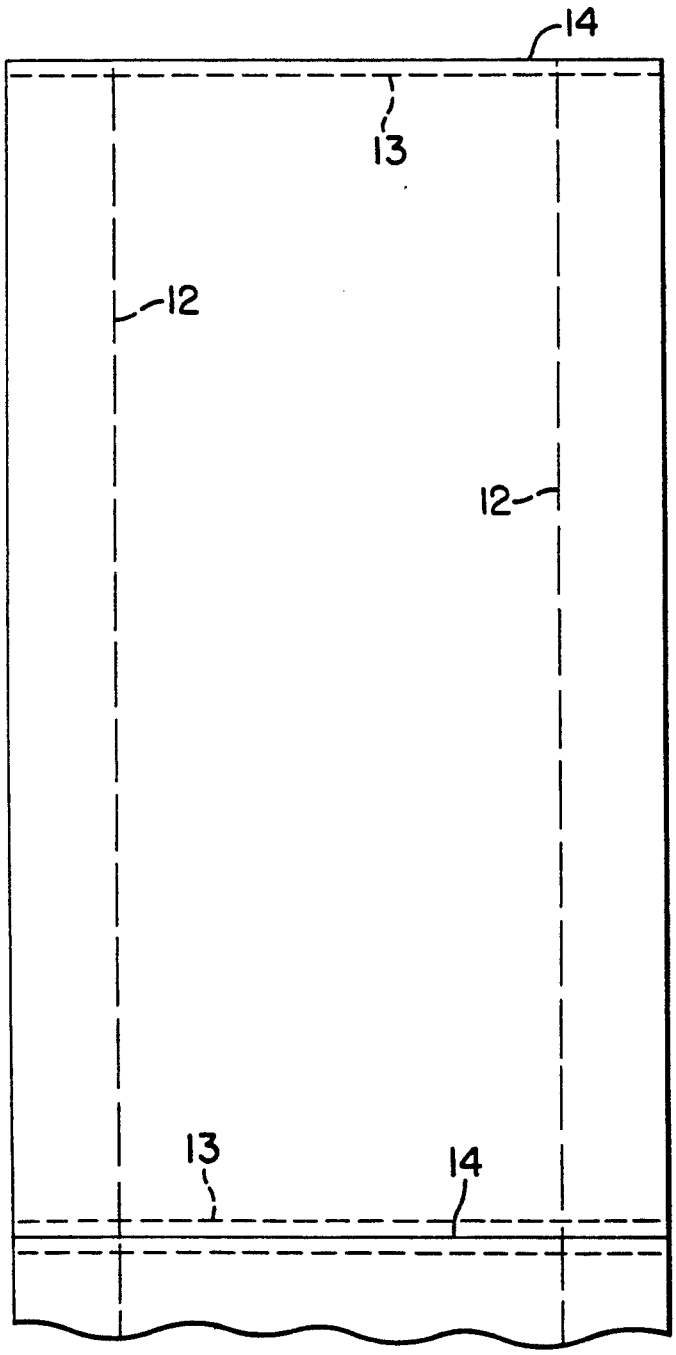
FIG. 2 is a plan view of the tube shown in FIG. 1 after it has been flatted and a pair of spaced apart transverse seals have been made across the flattened tube.
Figure 3:
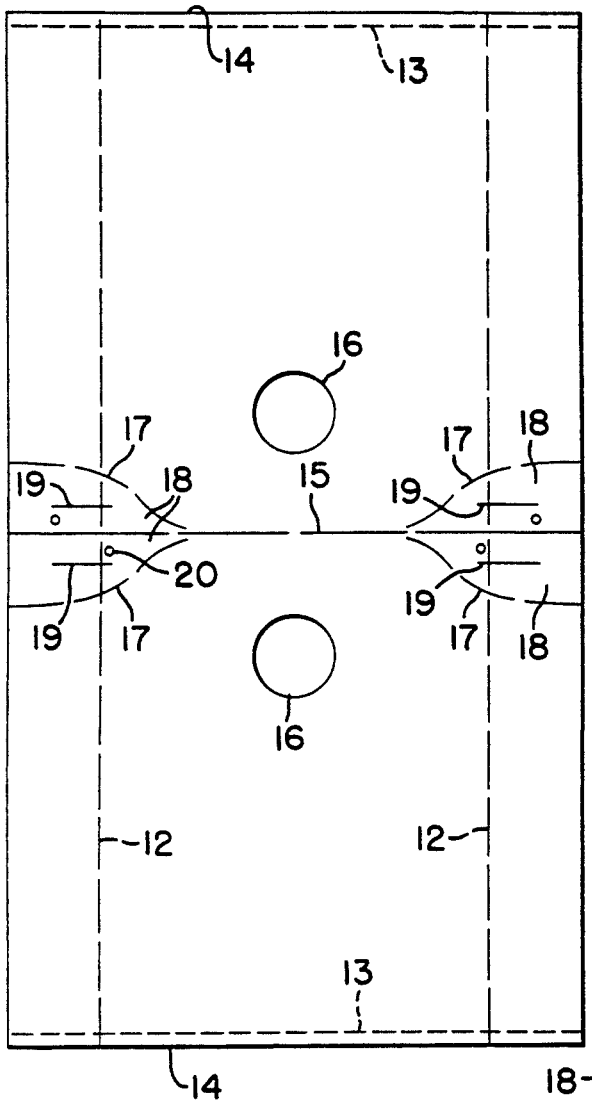
FIG. 3 is a plan view of a pair of interconnected bags or a stack of pairs of interconnected bags after they have been cut along their transverse seals and are subjected to the action of a cutting die intermediate the transverse seals.

As shown in FIG. 2, transverse seals 13 are formed across the flattened tube at spaced apart distances of two bag lengths. A pair of bags, open-end to open-end, can be made at this stage by subjecting the flattened tube midway between the transverse seals to the action of a cutting die, shown in FIG. 7. Preferably, however, the sealed, flattened tube is cut into successive two-bag lengths by cutting the tube transversely along lines 14 across the middle of the seals 13 and stacking a plurality of the cut lengths, e.g. 50 or 100, before subjecting the entire stack to a single operation of the cutting die. The heat sealing and cutting steps can be carried out in successive operations or simultaneously in a single operation.

Figure 4:
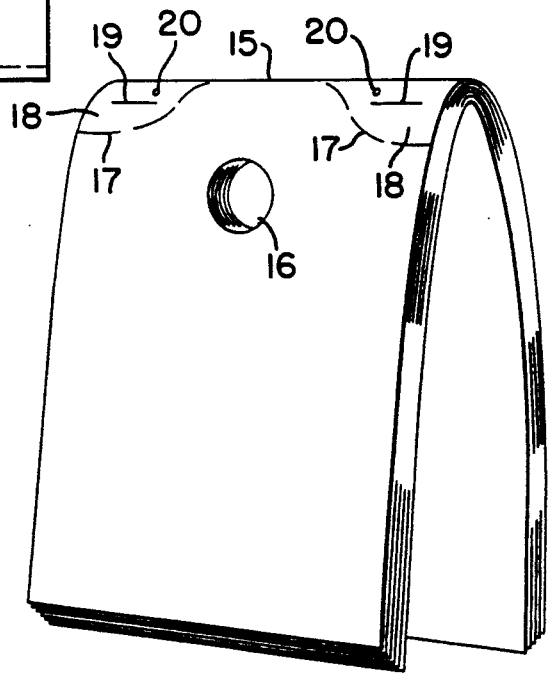
FIG. 4 is a perspective view showing a stack of bags folded along the weakened connections between the pairs of bags.

The cutting die simultaneously forms:

1) a transverse broken cut line 15 across the tube intermediate the cut ends 14 to produce a weakened connection between all the bag pairs in the stack to facilitate separation of individual bags;

2) a handle opening 16 on each side of the broken cut line 15 between the side gussets 12 to provide all of the bags in the stack with handle openings;

3) broken cut lines 17 forming detachable corner tabs 18 at both upper corners of each bag;

4) a slit 19 in each corner tab to permit the stack of bags to be suspended from a pair of arms or hooks of a support rack; and 5) hot or cold pressure spot welds 20 attaching together all of the corresponding corner tabs in the stack. The bags in the stack can be folded along the broken cut line 15, as shown in FIG. 4, for handling, packaging or dispensing.

Figure 5:
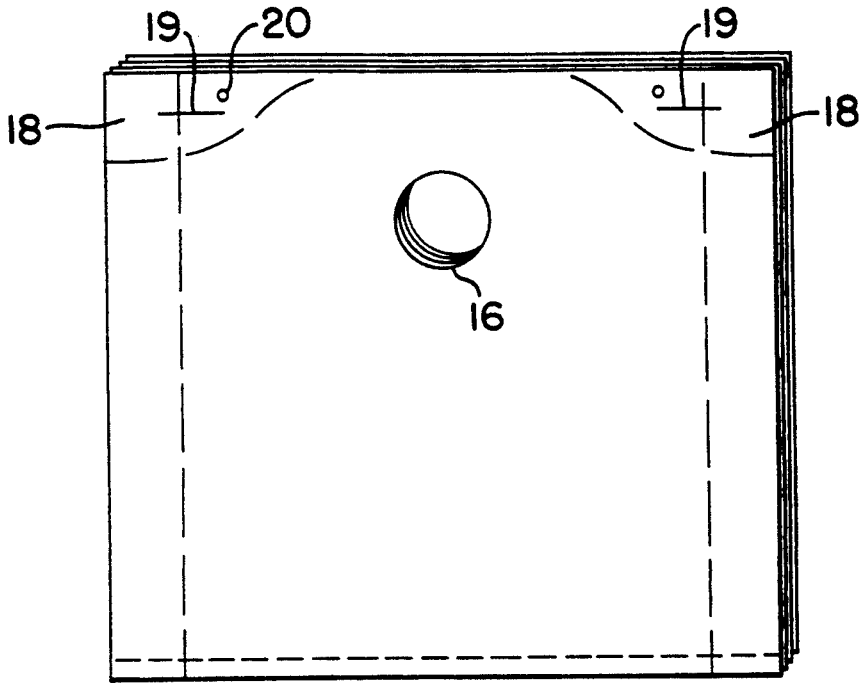
FIG. 5 is a perspective of a pack of bags separated from their interconnected pairs.
Figure 6:
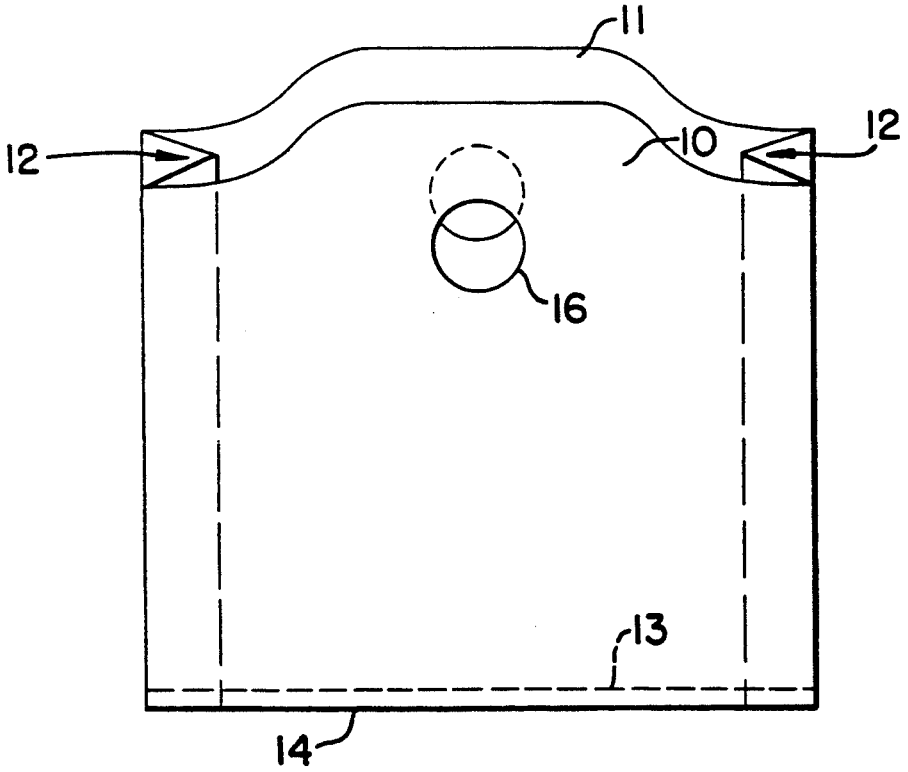
FIG. 6 is a perspective of a single bag with the corner tabs separated.

The pairs of interconnected bags can be separated along the weakened line 15 into two packs, as shown in FIG. 5, for use in conventional support racks having a pair of arms or hooks for receiving the slits 17. When the front bag in the pack is removed, the corner tabs are retained by the arms or hooks to provide a bag ready for use as shown in FIG. 6.

Figure 7:
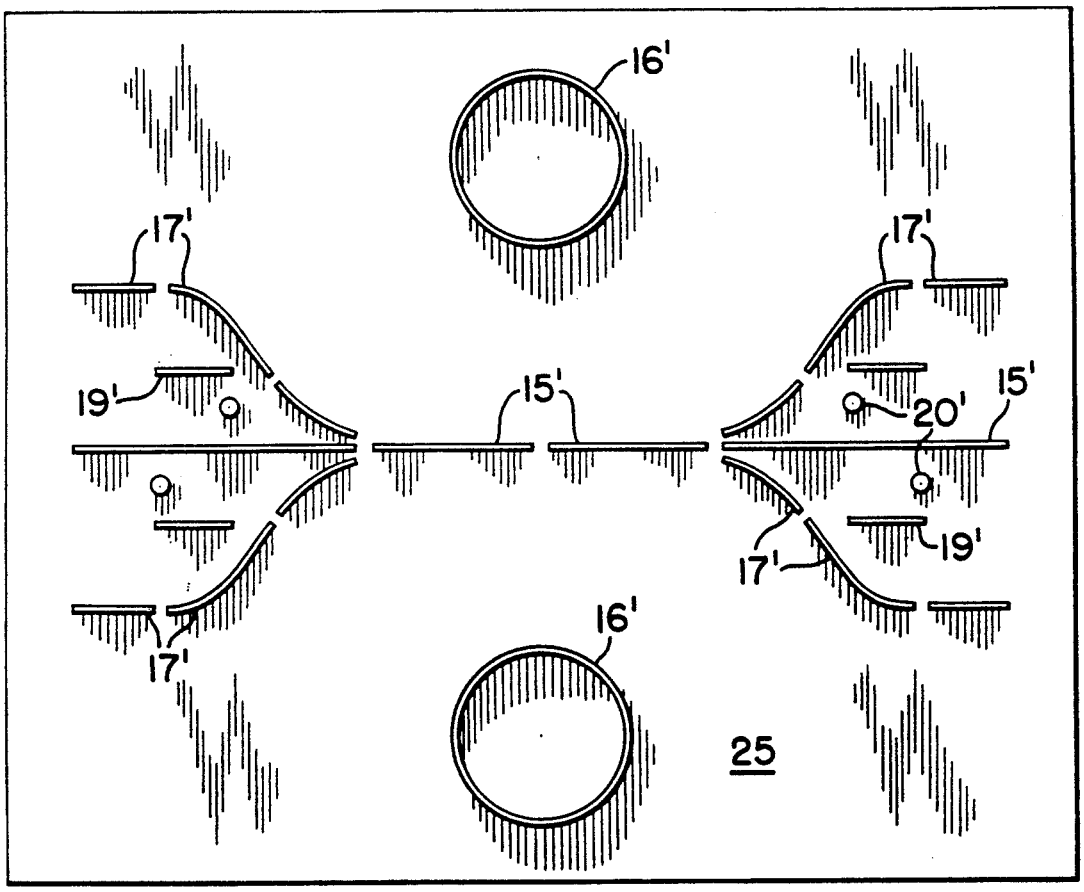
FIG. 7 is a face view of cutter die used in carrying out the method of the present invention.

The cutting die, shown in FIG. 7, includes a common support 25 having a series of in-line cutting blades 15' for forming the transverse broken cut line 15, circular blades 16' for cutting the handle holes 16, spaced apart blades 17' for forming the broken cut lines 17, blades 19' for cutting the slits 19 and pins 20' for making the spot welds 20 in the corner tabs. The cutting blades are all steel die-coated rule blades mounted from the common support 25 at the edges opposite the cutting edges.

The invention has been shown in preferred forms and by way of example, and many variations and modifications can be made within the scope of the invention. For example, different bag top styles, including the T-shirt style, can be produced in multiple lanes from the extruder, reducing cost and material in comparison with conventional bag making methods. The invention, therefore, is not intended to be limited to the particular forms or embodiments described herein.

I claim:

1. A method of producing detachable bags interconnected at their open ends comprising forming a pair of spaced apart transverse seals across a flattened, longitudinal tube to form a closed tube of film material and cutting with a cutting die a transverse weakened tear line extending across the entire width of the flattened, longitudinal tube intermediate the transverse seals and a pair of handle openings, one on each side of the transverse weakened tear line, the weakened tear line interconnecting two bags across the entire width of the flattened tube so that the bags can be separated by tearing across the full width of the tube.

2. A method as set forth in claim 1 including cutting the longitudinal tube along the transverse seals.

3. A method as set form in claim 2 including stacking a plurality of flattened, longitudinal tubes cut along spaced apart transverse seals and simultaneously cutting with the cutting die the transverse weakened tear lines and the handle openings in the stack, thereby forming a stack of pairs of interconnected detachable bags.

4. A method as set form in claim 3 including cutting with the cutting die weakened tear lines on both sides of the transverse weakened line to define detachable corner tabs for the interconnected bags and cutting with the cutting die a support opening in each detachable corner tab.

5. A method as set form in claim 4 in which the cutting die comprises a common support, a series of disconnected blades across the support for cutting the weakened transverse tear lines of the bags in the stack, a pair of blades carried by the support, one on each side of the disconnected blades, for cutting the handle openings, a plurality of disconnected blades carried by the support for cutting the detachable corner tabs and blades carried by the support for forming the openings in the corner tabs of the bags in the stack.

6. A method as set form in claim 5 in which the cutting die includes four sealing pins and including simultaneously sealing all of the detachable tabs of the stack of interconnected bags by pressure exerted by the pins during the cutting operations.

7. A cutting die for making bags interconnected at their open ends comprising a support having a face to which cutting blades are mounted, said cutting blades including a series of disconnected blades aligned end-to-end across the face for cutting a weakened tear line across the entire width of the bags at their open ends so that the bags can be separated by tearing across the full width of the bags, a curved blade carried by the support on each side of the series of disconnected blades and intermediate the opposite ends of the series of disconnected blades for cutting handle openings, disconnected blades carried by the supports on both sides of the series of disconnected blades and on both sides of the curved blades for cutting detachable corner tabs in the bags, and blades carried by the support for cutting an opening within each of the detachable corner tabs.

8. A cutting die as set forth in claim 7, including pins carried by the support for forming spot welds in the bags.

* * * * *

UNITED STATES PATENT AND TRADEMARK OFFICE

CERTIFICATE OF CORRECTION

PATENT NO. : 5,226,858

DATED : July 13, 1993

INVENTOR(S) : Snowdon

It is certified that error appears in the above-identified patent and that said Letters Patent is hereby corrected as shown below:

Col. 4, lines 3, 9, 15 and 25, "form" should read --forth--.

Signed and Sealed this

Fifteenth Day of March, 1994

Bruce Lehman

*Attest:*

BRUCE LEHMAN

*Attesting Officer*

*Commissioner of Patents and Trademarks*